US007117688B2

(12) United States Patent
Matsuoka et al.

(10) Patent No.: US 7,117,688 B2
(45) Date of Patent: Oct. 10, 2006

(54) REFRIGERATION DEVICE

(75) Inventors: Hiromune Matsuoka, Sakai (JP); Osamu Tanaka, Sakai (JP)

(73) Assignee: Dalkin Industries, Ltd., Osaka (JP)

( * ) Notice: Subject to any disclaimer, the term of this patent is extended or adjusted under 35 U.S.C. 154(b) by 286 days.

(21) Appl. No.: 10/482,691

(22) PCT Filed: Jun. 26, 2002

(86) PCT No.: PCT/JP02/06455

§ 371 (c)(1),
(2), (4) Date: Jan. 2, 2004

(87) PCT Pub. No.: WO03/008878

PCT Pub. Date: Jan. 30, 2003

(65) Prior Publication Data

US 2004/0231352 A1 Nov. 25, 2004

(30) Foreign Application Priority Data

Jul. 16, 2001 (JP) ..... 2001-215067

(51) Int. Cl.
*F25D 45/00* (2006.01)

(52) U.S. Cl. ..... 62/292; 62/149; 62/298

(58) Field of Classification Search ..... 62/77, 62/149, 292, 298, 299
See application file for complete search history.

(56) References Cited

FOREIGN PATENT DOCUMENTS

| | | |
|---|---|---|
| JP | 8-35748 | 2/1996 |
| JP | 8-49947 | 2/1996 |
| JP | 8-210736 | 8/1996 |
| JP | 9-229520 | 9/1997 |
| JP | 11-270933 | 10/1999 |
| JP | 2000-28211 | 1/2000 |
| JP | 2000-180000 | 6/2000 |
| JP | 2000-199660 | 7/2000 |
| JP | 2000-329431 | 11/2000 |
| JP | 2001-108335 | 4/2001 |
| JP | 2001-174109 | 6/2001 |

*Primary Examiner*—Melvin Jones
(74) *Attorney, Agent, or Firm*—Shiniyu Global IP Counselors

(57) ABSTRACT

The present invention allows an optimal quantity of refrigerant to be quickly and easily charged into the refrigeration device. In a refrigeration device that includes a refrigerant cycle circuit (A) connecting an outdoor unit (X) and indoor units (Y) via refrigerant lines (6), (7), a refrigerant charging device (10) that charges refrigerant to the refrigerant cycle circuit (A) in the cooling operational state is detachably connected to the liquid side refrigerant line (6) (the high pressure liquid line during cooling operations) that links the outdoor unit (X) with the indoor units (Y). In this way, when the refrigerant charging device (10) and the liquid line refrigerant line (6) are linked together and the refrigerant cycle circuit (A) is in the cooling operational state, refrigerant charging can be carried out from the refrigerant charging device (10) to the refrigerant cycle circuit (A) via the liquid side refrigerant line (6) (the high pressure liquid line).

6 Claims, 5 Drawing Sheets

REFRIGERATION DEVICE

TECHNICAL FIELD

The present invention relates to a separate-type refrigeration device.

BACKGROUND ART

As shown in FIG. 5, a separate-type refrigeration device well known in the prior art includes a refrigerant cycle circuit A in which a compressor 1, a four-way switching valve 2, an outdoor heat exchanger 3, a heating pressure reduction mechanism 4B, cooling pressure reduction mechanisms 4A, and indoor heat exchangers 5 are connected together in series. The outdoor heat exchanger 3 is used as a condenser during cooling operations, and used as an evaporator during heating operations. The indoor heat exchangers 5 are used as evaporators during cooling operations, and used as condensers during heating operations. In addition, the refrigeration device is separated into an outdoor unit X which has the compressor 1, the four-way switching valve 2, the outdoor heat exchanger 3, and the heating pressure reduction mechanism 4B, and indoor units Y which have the cooling pressure reduction mechanisms 4A and the indoor heat exchangers 5. The outdoor unit X and the indoor units Y are connected together via refrigerant lines 6, 7.

In this refrigeration device, the cooling cycle and the heating cycle are switched by switching the four-way switching valve 2. In the cooling cycle, refrigerant circulates in this way: the compressor 1→the four-way switching valve 2→the outdoor heat exchanger 3→the heating pressure reduction mechanism 4B→the cooling pressure reduction mechanisms 4A→the indoor heat exchangers 5→the four-way switching valve 2→the compressor 1. In the heating cycle, refrigerant circulates in this way: the compressor 1→the four-way switching valve 2→the indoor heat exchangers 5→the cooling pressure reduction mechanisms 4A→the heating pressure reduction mechanism 4B→the outdoor heat exchanger 3→the four-way switching valve 2→the compressor 1. In the refrigeration device shown in FIG. 5, two indoor units Y are connected to one outdoor unit X. Reference numerals 8, 9 are shut-off valves.

The separate-type refrigeration device described above produces a differential in the quantity of refrigerant needed by means of the distance between the outdoor unit and the indoor units. Because of this, there will be a need to charge the refrigeration device with the optimal quantity of refrigerant onsite. For example, conventionally a refrigerant charging operation is performed in which the outdoor unit X is charged in advance with a predetermined quantity of refrigerant, and then during installation onsite, an additional quantity of refrigerant is added in accordance with the length of the refrigerant lines 6, 7 that connect the outdoor unit X and the indoor units Y.

The aforementioned refrigerant charging is normally carried out while creating a vacuum in the refrigerant cycle circuit A. However, in situations in which refrigerant is not placed into the refrigerant cycle circuit A, as shown in FIG. 5, with the refrigerant cycle circuit A in the cooling cycle state (cooling operational state), a method is employed in which a cylinder V in which refrigerant is collected is connected to the shut-off valve 8 on the liquid side refrigerant line 6 (the high pressure liquid line) side thereof, the shut-off valve 8 is closed, and the cylinder V is weighed on an electric scale E while charging refrigerant into the refrigerant cycle circuit A.

One problem that occurs when employing the aforementioned method is that a workman must be present for a long period of time in order to perform this task. For example, in a situation in which 10 refrigeration devices are to be installed, assuming 20 horsepower and 70 m of line in wintertime (20 kg of refrigerant charged), then it will take 2 to 3 hours to charge each refrigeration device, and thus the total time needed for the task will be 20 to 30 hours (3 to 4 days). Moreover, compared to charging the refrigerant in a factory, the task of charging the refrigerant onsite means that handling the lines will be difficult, work efficiency will be poor, and it will be difficult to correctly charge the refrigerant.

In addition, as noted above, when the amount of refrigerant to be charged is determined onsite during installation, the performance and reliability of the equipment becomes dependent on the quality of the onsite installation and thus, in some cases, the maximum performance of the refrigeration device cannot be realized.

Accordingly, it is known to employ a method (i.e., a chargeless method) in which refrigerant for local lines that have this degree of length is charged into the refrigeration device in advance, and when the local lines are short, the remaining refrigerant is stored in a receiver or the like inside the refrigerant cycle circuit. However, in this method, when the lines are short, unneeded refrigerant is always charged in the receiver or the like, and not only is the reliability of the equipment worse, but a receiver of an unnecessary size is needed and an unnecessary amount of refrigerant is needed. As a result, problems such as an increase in costs, an increased burden on the user, and harmful impact on the environment will be produced. In particular, this problem will be conspicuous in systems (refrigeration devices) in which there is a large quantity of refrigerant, like with multi systems for buildings.

DISCLOSURE OF THE INVENTION

An object of the present invention is to simply and quickly charge a refrigeration device with an optimal quantity of refrigerant.

The refrigeration device according to claim 1 includes an outdoor unit, an indoor unit, a liquid side refrigerant line and a gas side refrigerant line, and a refrigerant charging device. The outdoor unit includes a compressor, an outdoor heat exchanger, and a heating pressure reduction mechanism. The outdoor heat exchanger is used as a condenser during cooling operations, and used as an evaporator during heating operations. The indoor unit includes a pressure reduction mechanism for cooling and an indoor heat exchanger. The indoor heat exchanger is used as an evaporator during cooling operations, and used as a condenser during heating operations. The liquid side refrigerant line and the gas side refrigerant line connect the outdoor unit and the indoor unit and form a refrigerant cycle circuit. The refrigerant charging device is detachably connected to the liquid side refrigerant line, and charges refrigerant into the refrigerant cycle circuit.

By configuring the refrigeration device as described above, the refrigerant charging device and the liquid side refrigerant line will be linked together and refrigerant will be charged from the refrigerant charging device to the refrigerant cycle circuit in the cooling operational state via the liquid side refrigerant line (the high pressure line). Then, if the link between the refrigerant charging device and the liquid side refrigerant line is cut at the point at which a sufficient quantity of refrigerant has been charged, the refrigerant charging can be completed. In other words, an optimal quantity of refrigerant will be quickly and easily charged into the refrigeration device.

Note that if the refrigerant charging device can be externally connected to the outdoor unit X, the refrigerant charging device can be connected as an option to only a refrigeration device that requires it.

The refrigeration device according to claim 2 is the refrigeration device disclosed in claim 1, in which the refrigerant charging device charges refrigerant into the refrigerant cycle circuit in the cooling operational state.

The refrigeration device according to claim 3 is the refrigeration device disclosed in claim 2, in which the refrigerant charging device includes a refrigerant tank which stores refrigerant for charging, and a refrigerant switching mechanism that switches the conduction/non-conduction of a refrigerant charging circuit that passes through the refrigerant tank in the cooling operation state.

With this refrigeration device, refrigerant charging is carried out from the refrigerant tank to the refrigerant cycle circuit due to the conduction of the refrigerant charging circuit, and the refrigerant charging is completed due to the non-conduction of the refrigerant charging circuit. Here, an optimal quantity of refrigerant can be quickly and easily charged with a refrigerant charging device having a refrigerant tank and a refrigerant switching mechanism and a simplified structure.

The refrigeration device according to claim 4 is the refrigeration device disclosed in any of claims 1 to 3, in which the refrigerant charging device includes a heat exchanger serially connected to the outdoor heat exchanger.

Here, a heat exchanger having the same function as the outdoor heat exchanger in the outdoor unit is added to the refrigerant cycle circuit by connecting the refrigerant charging device thereto. In this way, the performance of the outdoor heat exchanger can be adjusted by connecting the refrigerant charging device.

The refrigeration device according to claim 5 is the refrigeration device disclosed in any of claims 1 to 4, further comprising refrigerant charging control means that carries out refrigerant charging with the refrigerant charging device for only a predetermined time period.

Here, an appropriate quantity of refrigerant charging will always be obtained by carrying out refrigerant charging for only a predetermined time period.

Note that because refrigerant charging is not carried out after the liquid side refrigerant line (the high pressure liquid line portion) in the refrigerant charging circuit is filled with liquid refrigerant, the appropriate quantity of refrigerant charging will occur even in situations in which the line onsite is long if the predetermined time period is set to be slightly longer.

The refrigeration device according to claim 6 is the refrigeration device disclosed in claim 3, further comprising pump down control means that switches the refrigerant switching mechanism and carries out pump down operations such that the refrigerant charging circuit conducts with the refrigerant cycle circuit in the heating operational state. Here, refrigerant in the refrigerant cycle circuit can be withdrawn to the refrigerant tank in the refrigerant charging device.

The refrigeration device according to claim 7 is the refrigeration device disclosed in claim 6, and further comprises a low pressure pressure detection means that is disposed on the intake side of the compressor. Then, the pump down control means stops pump down operations at the point in which the value detected by the low pressure pressure detection means is equal to or less-than a predetermined value.

Here, the pump down operation is stopped at the point at which the pressure on the intake side of the compressor is lowered to a value that is equal to or less than a predetermined value (in other words, the point at which the refrigerant remaining in the refrigerant cycle circuit is almost gone), and thus the withdrawal of the refrigerant to the refrigerant tank can be accurately carried out.

BEST MODES FOR CARRYING OUT THE INVENTION

First Embodiment

Figure 1:
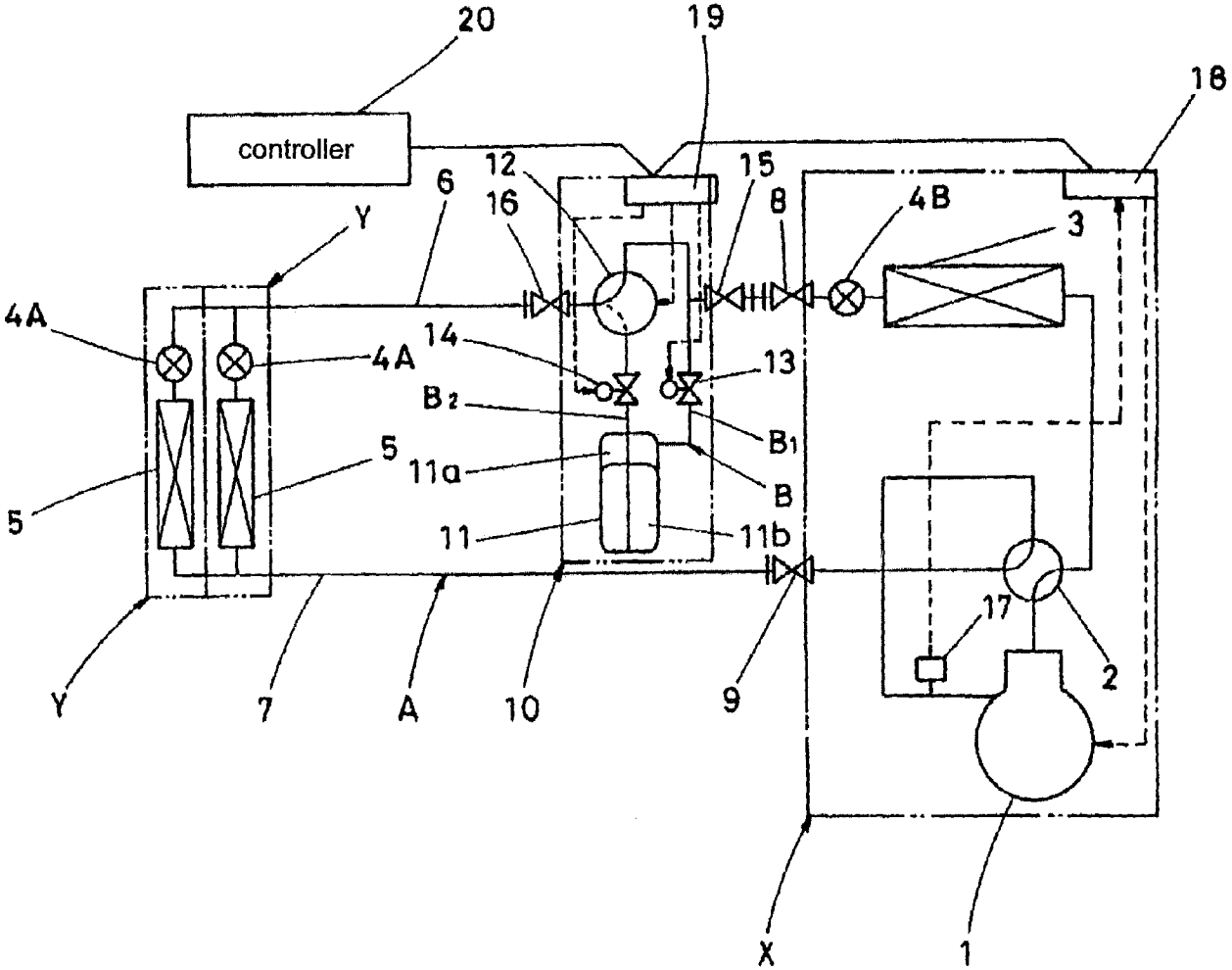
FIG. 1 is a refrigerant circuit of a refrigeration device according to a first embodiment of the present invention.

FIG. 1 shows a refrigerant circuit of a refrigeration device according to a first embodiment of the present invention.

Like the description provided in the Background Art section, this refrigeration device includes a refrigerant cycle circuit A in which a compressor 1, a four-way switching valve 2, an outdoor heat exchanger 3, a heating pressure reduction mechanism 4B, cooling pressure reduction mechanisms 4A, and indoor heat exchangers 5 are connected together in series. The outdoor heat exchanger 3 is used as a condenser during cooling operations, and used as an evaporator during heating operations. The indoor heat exchangers 5 are used as evaporators during cooling operations, and used as condensers during heating operations. The refrigeration device is separated into an outdoor unit X and indoor units Y, and the outdoor unit X and the indoor units Y are connected together by means of a liquid side refrigerant line 6 and a gas side refrigerant line 7. The outdoor unit X has the compressor 1, the four-way switching valve 2, the outdoor heat exchanger 3, and the heating pressure reduction mechanism 4B. Each indoor unit Y has the cooling pressure reduction mechanism 4A and the indoor heat exchanger 5.

In this refrigeration device, the cooling cycle (cooling operational state) and the heating cycle (heating operational state) are switched by switching the four-way switching valve 2. In the cooling cycle, refrigerant circulates in this way: the compressor 1→the four-way switching valve 2→the outdoor heat exchanger 3→the heating pressure reduction mechanism 4B→the cooling pressure reduction mechanisms 4A→the indoor heat exchangers 5→the four-way switching valve 2→the compressor 1. In the heating cycle, refrigerant circulates in this way: the compressor 1→the four-way switching valve 2→the indoor heat exchangers 5→the cooling pressure reduction mechanisms 4A→the heating pressure reduction mechanism 4B→the outdoor heat exchanger 3→the four-way switching valve 2→the compressor 1. In the refrigeration device shown in FIG. 1, two indoor units Y are connected to one outdoor unit X. Reference numerals 8, 9 are shut-off valves.

A refrigerant charging device 10 is detachably connected to the liquid side of the refrigerant line 6, which links the outdoor unit X and the indoor units Y together and which is a high pressure liquid line during cooling operations. The refrigerant charging device 10 charges refrigerant into the refrigerant cycle circuit A in the cooling operational state.

The refrigerant charging device 10 includes a refrigerant tank 11 that stores refrigerant for charging, and a refrigerant switching mechanism 12. The refrigerant switching mechanism 12 switches a refrigerant charging circuit B that passes through the refrigerant tank 11 between a conducting state and a non-conducting state during cooling operations. In the present embodiment, a three-way switching valve is employed as the refrigerant switching mechanism 12. Solenoid valves 13, 14 are arranged in the refrigerant charging circuit B before and after the refrigerant tank 11. The solenoid valves 13, 14 are opened or closed when the refrigerant charging circuit B is in the conducting state or the non-conducting state. Here, the downstream end of a conduit $B_1$ that connects the refrigerant tank 11 and the liquid side refrigerant line 6 is connected to a gas phase portion 11*a* in the refrigerant tank 11, and the upstream end of a conduit $B_2$ that connects the refrigerant tank 11 with the three-way switching valve 12 is connected to the lower end of a liquid phase portion 11*b* of the refrigerant tank 11. This type of connection allows only liquid refrigerant to be drawn from the refrigerant tank 11 during refrigerant charging, and only gaseous refrigerant to be drawn from the refrigerant tank 11 during pump down. Reference numerals 15, 16 are shut-off valves that are used when connecting the refrigerant charging device 10.

In addition, a control circuit board 18 is arranged in the outdoor unit X. Pressure data from a pressure sensor 17 which is used as a low pressure pressure detection means that detects the pressure on the intake side of the compressor 1 is input into the control circuit board 18. In addition, the control circuit board 18 outputs signals that control the operation of the compressor 1. A control circuit board 19 that outputs control signals to the three-way switching valve 12 and the solenoid valves 13, 14 is arranged in the refrigerant charging device 10. A controller 20 that transmits signals to and receives signals from the control circuit boards 18, 19 is attached to the refrigeration device.

The controller 20 functions as refrigerant charging control means that carries out refrigerant charging operations for only a predetermined time ts by means of the refrigerant charging device 10, and also functions as pump down control means that switches the three-way switching valve 12 to conduct pump down operations such that the refrigerant charging circuit B is allowed to conduct with the refrigerant cycle circuit A in the heating cycle state. Note that the pump down operation carried out by the pump down control means is stopped at the point that a detected value P that was detected by the pressure sensor 17 is equal to or less than a predetermined value Ps.

The refrigerant charging operation and the pump down operation will be described with reference to the flowcharts in FIGS. 2 and 3.

Figure 2:
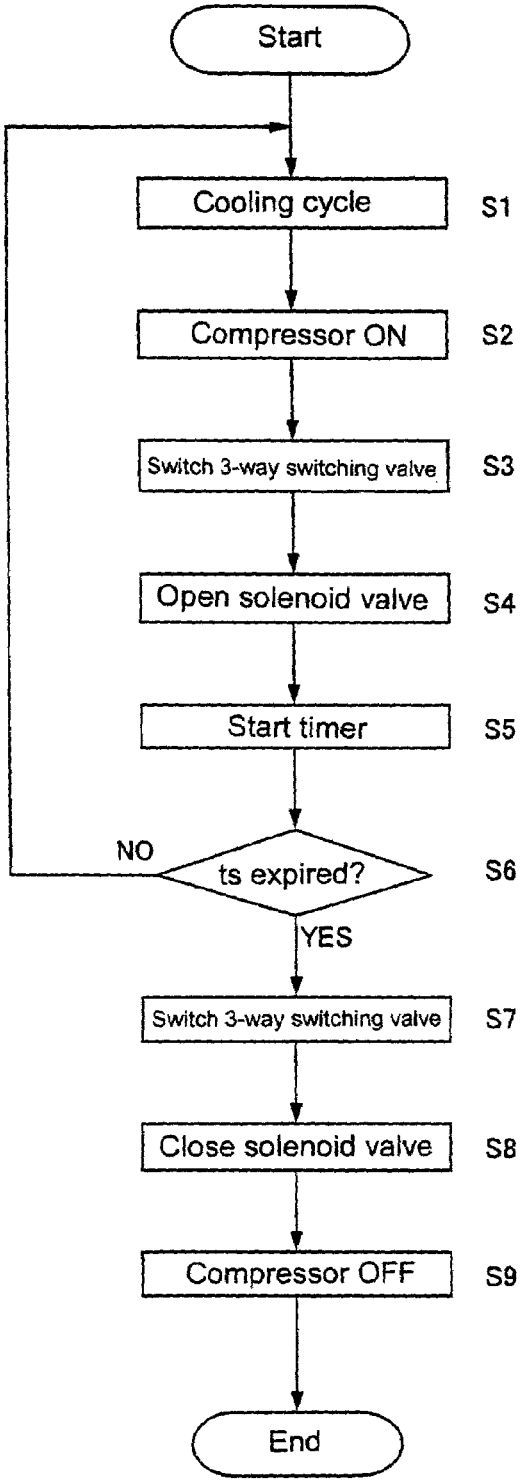
FIG. 2 is a flowchart illustrating the control of a refrigerant charging operation in the refrigeration device according to the first embodiment of the present invention.

(I) Refrigerant Charging Operation (See the Flowchart in FIG. 2)

In Step S1, the four-way switching valve 2 is switched to the cooling cycle side, in Step S2, the compressor 1 drive is initiated, in Step S3, the three-way switching valve 12 is switched such that the refrigerant charging circuit B conducts, and in Step S4, the solenoid valves 13, 14 are opened. Then, in Step S5, the ts timer is started. The refrigerant charging operation is continued in the aforementioned state until it is determined that the predetermined time ts has expired in Step S6.

If it is determined in Step S6 that the predetermined time ts has expired, then in Step S7, the three-way switching valve 12 is switched such that the refrigerant charging circuit B does not conduct, in Step S8, the solenoid valves 13, 14 are closed, and in Step S9, the compressor 1 drive is stopped and the refrigerant charging operation is completed.

As noted above, when the refrigerant charging circuit B conducts with the refrigerant cycle circuit A in the cooling operational state, refrigerant charging is carried out from the refrigerant charging device 10 to the refrigerant cycle circuit A via the liquid side refrigerant line 6 (the high pressure liquid line). Then, at the point in which the required quantity of refrigerant charging has been obtained (i.e., the point at which the predetermined time ts has expired), the connection between the refrigerant charging device 10 and the liquid side refrigerant line 6 is cut, and the refrigerant charging is completed. Because of this, an optimal quantity of refrigerant will be quickly and easily charged into the refrigeration device.

Note that because the refrigerant charging device 10 can be externally connected to the outdoor unit X, the refrigerant charging device 10 can be connected as an option to only the refrigeration device that requires it. In addition, an appropriate quantity of refrigerant charging can be obtained by carrying out the refrigerant charging operation for only the predetermined time period ts. However, because refrigerant charging is not performed after the liquid side refrigerant line 6 (the high pressure liquid line portion) in the refrigerant cycle circuit A is filled with liquid refrigerant, the appropriate quantity of refrigerant charging will occur even in situations in which the line onsite is long if the predetermined time period ts is set to be slightly longer.

Figure 3:
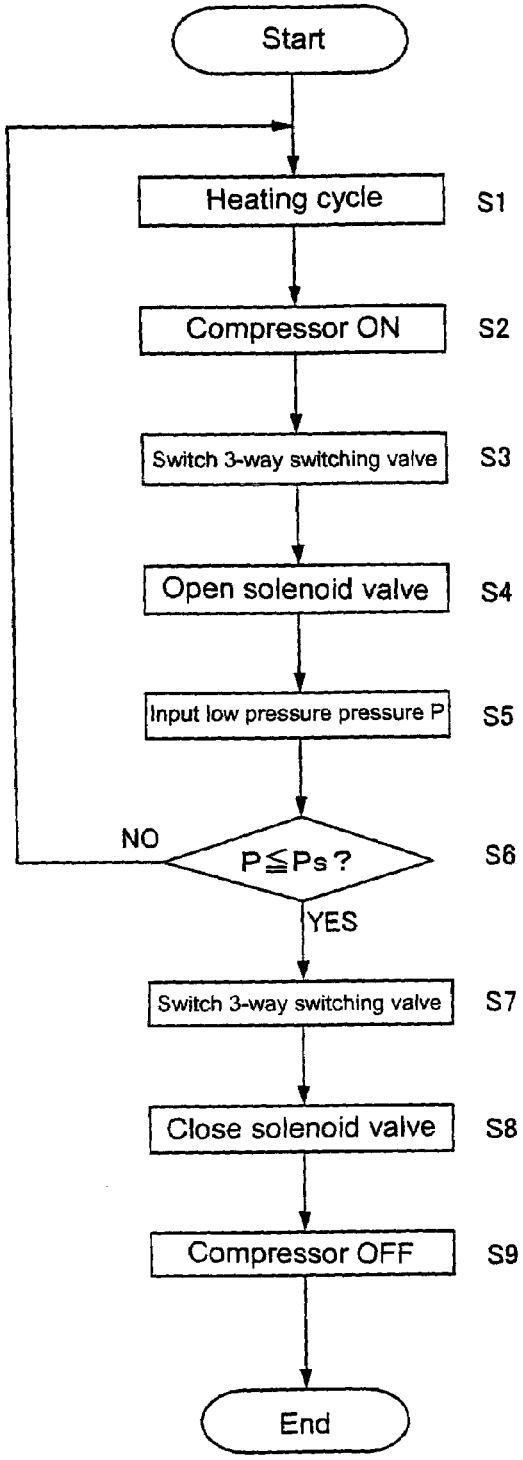
FIG. 3 is a flowchart illustrating the control of a pump down operation in the refrigeration device according to the first embodiment of the present invention.

(II) Pump Down Operation (See the Flowchart in FIG. 3)

In Step S1, the four-way switching valve 2 is switched to the heating cycle side, in Step S2, the compressor 1 drive is initiated, in Step S3, the three-way switching valve 12 is switched such that the refrigerant charging circuit B conducts, and in Step S4, the solenoid valves 13, 14 are opened. Then in Step S5, pressure data (i.e., the low pressure pressure P) from the pressure sensor 17 is input to the controller 20. In pump down operations in the aforementioned state, liquid refrigerant is collected in the refrigerant tank 11 in the refrigerant charging device 10, and the detected pressure P of the pressure sensor 17 is gradually lowered. This pump down operation continues until it is determined in Step S6 that the detected value P is reduced to equal to or less than the predetermined value Ps. Here, the predetermined value Ps is the low pressure pressure in the refrigerant cycle circuit A in the state in which the refrigerant almost gone.

If it is determined in Step S6 that P is less than or equal to Ps, then in Step S7, the three-way switching valve 12 is switched such that the refrigerant charging circuit B does not conduct, in Step S8, the solenoid valves 13, 14 are closed, and in Step S9, the compressor 1 drive is stopped and the refrigerant charging operation is completed.

As noted above, the withdrawal of the refrigerant to the refrigerant tank 11 can be accurately performed because the pump down operation is stopped at the point at which the pressure on the intake side of the compressor 1 is lowered to a value that is equal to or less than a predetermined value (in other words, the point at which the refrigerant remaining in the refrigerant cycle circuit A is almost gone).

Second Embodiment

Figure 4:
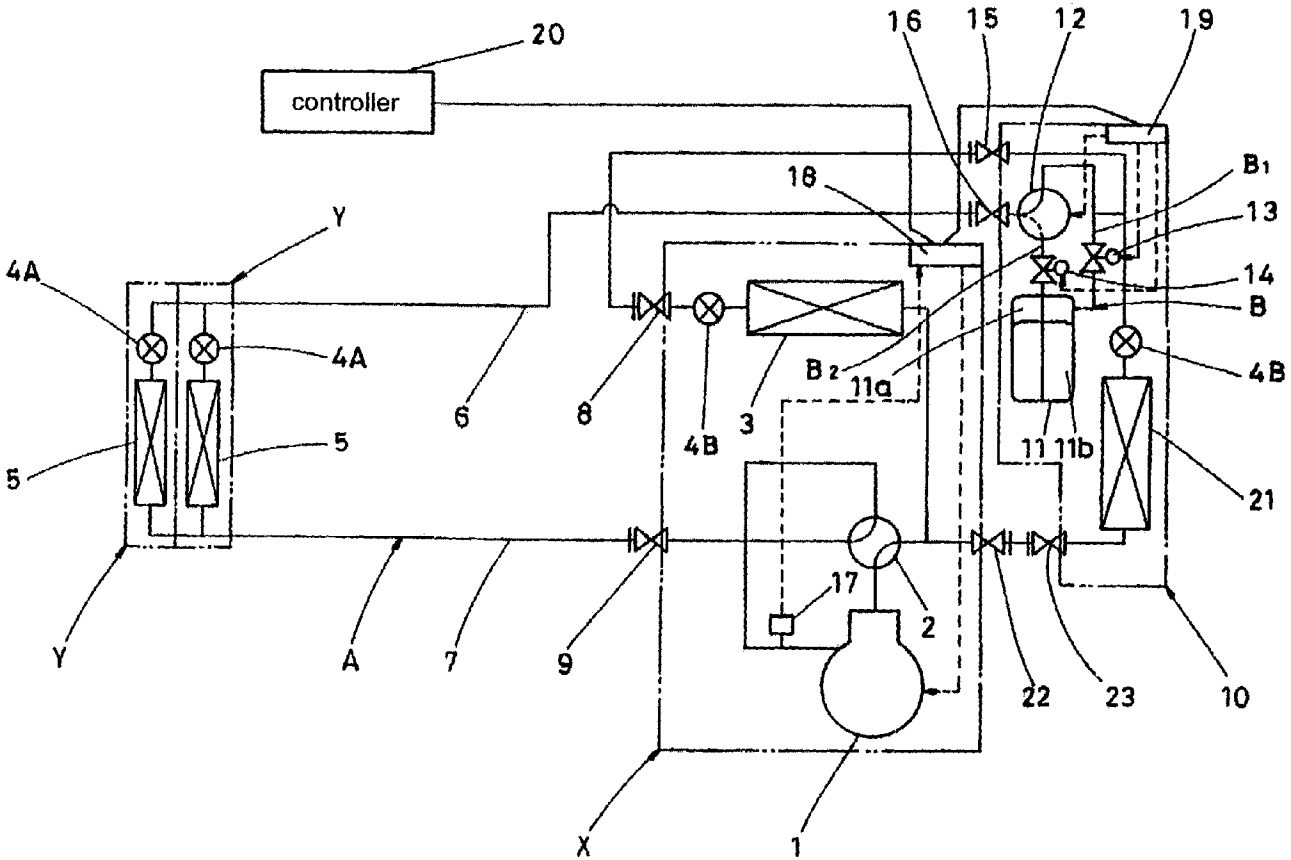
FIG. 4 is a refrigerant circuit of a refrigeration device according to a second embodiment of the present invention.
Figure 5:
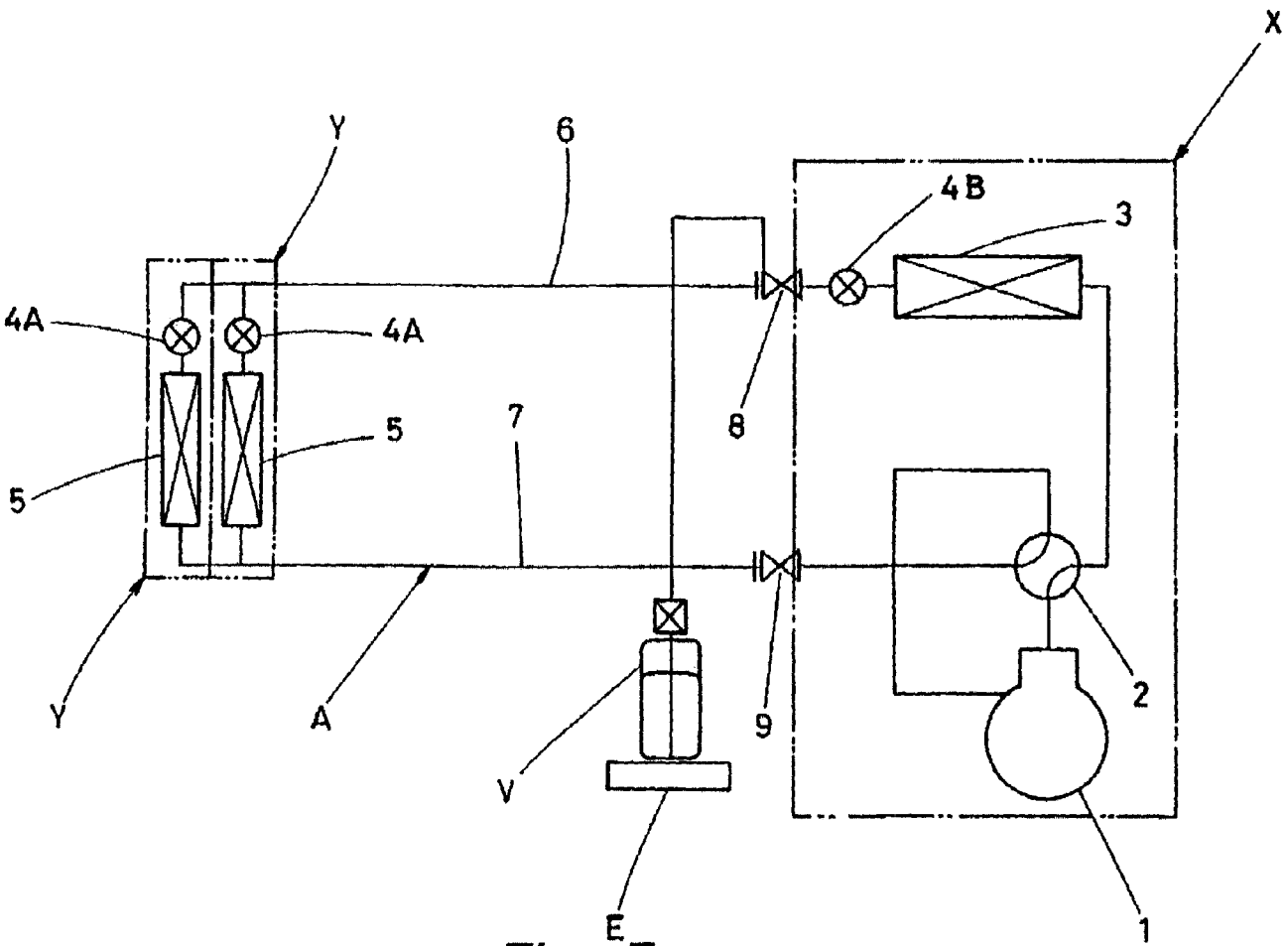
FIG. 5 is a refrigerant circuit of a prior art refrigeration device.

FIG. 4 shows a refrigerant circuit of a refrigeration device according to a second embodiment of the present invention.

Here, a heat exchanger 21 that is serially connected with the outdoor heat exchanger 3 is provided. The heating pressure reduction mechanism 4B is arranged on the output side during cooling operations of the heat exchanger 21. Reference numerals 22, 23 are shut-off valves. When configured as described above, by connecting the refrigerant charging device 10, a heat exchanger 21 having the same functions as the outdoor heat exchanger 3 in the outdoor unit X will be added to the refrigerant cycle circuit A, and thus the performance of the outdoor heat exchanger 3 can be adjusted due to the connection of the refrigerant charging device 10 thereto. The remaining configuration and effects of this embodiment are identical to those of the first embodiment, and thus a description thereof will be omitted.

INDUSTRIAL APPLICABILITY

If the present invention is used, the refrigerant charging device 10 and the liquid side refrigerant line 6 will be linked together and refrigerant will be charged from the refrigerant charging device 10 to the refrigerant cycle circuit A in the cooling operational state, and an optimal quantity of refrigerant charging will be quickly and easily carried out if the link between the refrigerant charging device 10 and the liquid side refrigerant line 6 is cut at the point in which a sufficient quantity of refrigerant charging has been obtained.

The invention claimed is:

1. A refrigeration device, comprising:

an outdoor unit having a compressor, an outdoor heat exchanger used as a condenser during cooling operations and as an evaporator during heating operations, and a heating pressure reduction mechanism;

an indoor unit having a cooling pressure reduction mechanism and an indoor heat exchanger used as an evaporator during cooling operations and as a condenser during heating operations;

a liquid side refrigerant line and a gas side refrigerant line that connect the outdoor unit and the indoor unit and form a refrigerant cycle circuit; and a refrigerant charging device detachably connected to the liquid side refrigerant line and which charges refrigerant into the refrigerant cycle circuit, the refrigerant charging device including a refrigerant charging circuit having a refrigerant tank that stores refrigerant for charging, a first conduit that flows refrigerant from the refrigerant cycle circuit to the refrigerant tank in a cooling operational state, a second conduit that draws refrigerant from the refrigerant tank to the refrigerant cycle circuit in the cooling operational state, and a refrigerant switching mechanism that switches between conduction and non-conduction of the refrigerant charging circuit.

2. A refrigeration device comprising:

an outdoor unit having a compressor, an outdoor heat exchanger used as a condenser during cooling operations and as an evaporator during heating operations, and a heating pressure reduction mechanism;

an indoor unit having a cooling pressure reduction mechanism and an indoor heat exchanger used as an evaporator during cooling operations and as a condenser during heating operations;

a liquid side refrigerant line and a gas side refrigerant line that connect the outdoor unit and the indoor unit and form a refrigerant cycle circuit; and a refrigerant charging device detachably connected to the liquid side refrigerant line and which charges refrigerant into the refrigerant cycle circuit, the refrigerant charging device including a heat exchanger serially connected to the outdoor heat exchanger.

3. The refrigeration device disclosed in claim 1, further comprising a refrigerant charging control means that carries out refrigerant charging with the refrigerant charging device for only a predetermined time period.

4. A refrigeration device comprising:

an outdoor unit having a compressor, an outdoor heat exchanger used as a condenser during cooling operations and as an evaporator during heating operations, and a heating pressure reduction mechanism;

an indoor unit having a cooling pressure reduction mechanism and an indoor heat exchanger used as an evaporator during cooling operations and as a condenser during heating operations;

a liquid side refrigerant line and a gas side refrigerant line that connect the outdoor unit and the indoor unit and form a refrigerant cycle circuit; and a refrigerant charging device detachably connected to the liquid side refrigerant line and which charges refrigerant into the refrigerant cycle circuit in a cooling operational state, the refrigerant charging device including a refrigerant tank that stores refrigerant for charging, and a refrigerant switching mechanism that switches between conduction/non-conduction of a refrigerant charging circuit that passes through the refrigerant tank in the cooling operational state; and a pump down control means that switches the refrigerant switching mechanism and carries out pump down operations such that the refrigerant charging circuit conducts refrigerant with the refrigerant cycle circuit in the heating operational state.

5. The refrigeration device disclosed in claim 4, further comprising a low pressure detection means that is disposed on an intake side of the compressor, wherein the pump down control means stops pump down operations at the point in which a value detected by the low pressure detection means is equal to or less than a predetermined value.

6. The refrigeration device disclosed in claim 1, wherein the refrigerant charging device further includes a third conduit that becomes a part of the refrigerant cycle circuit when the refrigerant charging circuit does not conduct.

* * * * *